US005304960A

United States Patent [19]

Das

[11] Patent Number: 5,304,960

[45] Date of Patent: Apr. 19, 1994

[54] FERROELECTRIC TOTAL INTERNAL REFLECTION RF SWITCH

[76] Inventor: Satyendranath Das, P.O. Box 6223, Washington, D.C. 20015

[21] Appl. No.: 41,205

[22] Filed: Apr. 1, 1993

[51] Int. Cl.[5] ..... H01P 1/10

[52] U.S. Cl. ..... 333/101; 333/99 S; 505/866

[58] Field of Search ..... 333/101, 99 R, 99 S; 505/860, 866

[56] References Cited

U.S. PATENT DOCUMENTS

| | | | |
|---|---|---|---|
| 3,633,123 | 1/1972 | Marcatili | 333/115 X |
| 3,741,625 | 6/1973 | Saleh | 333/109 X |
| 4,034,315 | 7/1977 | Unrau | 333/109 |
| 4,252,442 | 2/1981 | Dandliker et al. | 250/550 X |
| 4,473,806 | 9/1984 | Johnston | 333/101 |
| 5,212,463 | 5/1993 | Babbitt et al. | 333/161 |

*Primary Examiner*—Paul Gensler

[57] ABSTRACT

An electronically controlled ferroelectric RF switch is an active medium formed from a ferroelectric material the permittivity, and as such the refractive index, of which may be varied by varying the strength of an electric field in which it is immersed. The ferroelectric RF switch includes the ferroelectric material having electrodes or conductors mounted thereon that are connected to an adjustable d.c. or a.c. voltage source. The switch may be placed in an RF transmission line that includes appropriate input and output impedance matching devices such as quarterwave transformers. The active medium of the RF switch is constructed of two prismatic structures of a ferroelectric material. When the two prisms are at the same zero bias voltage, then the RF energy passing through the switch is not deflected and the switch is in the OFF condition. Application of a bias voltage reduces the permittivity and the refractive index of the outer prismatic structure. The RF energy is refracted away from the normal at the interface between the prismatic surfaces. When the magnitude of the bias voltage is sufficiently high and the permittivity and the refractive index of the outer prismatic structure are sufficiently reduced, total internal reflection of the RF energy takes place at the boundary of the two prismatic surfaces and the switch is switched ON, and the RF energy appears on another port. The ferroelectric RF switch may be embedded as part of a microwave integrated circuit. The ferroelectric RF switch may be constructed of thin ferroelectric film. The copper losses may be reduced by using a high Tc superconductor material as the conducting surface. The ferroelectric material is operated in the paraelectric phase slightly above its Curie temperature. The switch is reciprocal between the conductive ports.

10 Claims, 2 Drawing Sheets

FERROELECTRIC TOTAL INTERNAL REFLECTION RF SWITCH

BACKGROUND OF THE INVENTION

1. Field of the Invention

The present invention relates to switches for electromagnetic waves and, more particularly, to RF switches which may be controlled electronically.

2. Description of the Prior Art

In many fields of electronics, it is often necessary to switch the signal from one circuit to another. Commercial semiconductor and ferrite type switches are available.

Ferroelectric materials have a number of attractive properties. Ferroelectrics can handle high peak power. The average power handling capacity is governed by the dielectric loss of the material. They have low switching time (such as 100 nS). Some ferroelectrics have low losses. The permittivity of ferroelectrics is generally large, as such the device is small in size. The ferroelectrics are operated in the paraelectric phase i.e. slightly above the Curie temperature. The ferroelectric switches can be made of thin films, and can be integrated with other microwave/RF devices. Inherently, they have a broad bandwidth. They have no low frequency limitation as in the case of ferrite switches. The high frequency operation is governed by the relaxation frequency, such as 95 GHz for strontium titanate, of the ferroelectric material. The loss of the switch is low with ferroelectric materials with a low loss tangent. A number of ferroelectric materials are not subject to burnout.

A multi-stub transmission-reflection type ferroelectric switch has been studied (1). The optical deflection and modulation by a ferroelectric device has been studied (2,3). A liquid ferroelectric optical switch has been reported (4). A patent was issued on an RF phase shifter (5).

No publication has so far been made on ferroelectric type RF total internal reflection. There are significant differences between the RF and optical deflectors. In the optical deflector, the light ray travels through a very small portion of the active medium. In the RF switch, the RF energy will travel through the entire portion of the active medium. The wavelength of RF is several orders of magnitudes greater than the optical wavelengths.

The dimensions of the optical deflector are many times the optical wavelengths. The optical beam diameter is many times the optical wavelength. The width of the switch is generally a fraction of the RF wavelength. The biasing circuit, for the optical deflector, is far away from the optical beam. The biasing circuit, in the case of the RF switch, has to be isolated, by design, from the RF circuit. The biasing field, in the case of optical deflector, can be parallel or perpendicular to the direction of the electrical field of the optical beam. For the RF switch, the direction of the biasing field is parallel to the direction of the electrical field of the RF beam. After deflection, the optical beam travels a medium of same impedance as the incident beam.

The ferroelectric rf switch provides a third alternative to the semiconductor and ferrite switches. Depending on a trade-off studies in individual cases, the best type of switch can be selected.

SUMMARY OF THE INVENTION

The general purpose of this invention is to provide an electronically controlled RF switch which embraces most of the advantages of similarly employed conventional devices such as the semiconductor and ferrite RF switches. The ferroelectric RF switches are not susceptible to the magnetic fields and have the capability for direct integration into the packaging and structures of microwave and millimeter wave integrated circuits.

To attain this, the present invention contemplates the use of a transmission line formed from a material whose permittivity and the refractive index are changed by changing an applied d.c. or a.c. electric field in which it is immersed. When the reduction in the refractive index of a section of the transmission line is of sufficient magnitude, then the total internal reflection of the RF energy takes place and the RF switch is switched on.

It is an object of this invention to provide a voltage controlled ferroelectric switch which uses lower control power and is capable of handling higher peak power than conventional RF switches. Another object of the present invention is to provide an RF switch which can be integrated into the structure of microwave and millimeter wave monolithic integrated circuits.

Another object of this invention is to provide m inputs and n outputs i.e. mxn switches.

These and other objectives are achieved in accordance with the present invention which comprises of an RF transmission line having an input matching section, an active section made into two prismatic structures, and an output matching section. For RF energy to travel to a different direction when the switch is switched ON, a third output matching section is provided. The active section is constructed from a solid or liquid ferroelectric material, such as strontium-lead titanate, the permittivity and the refractive index of which change with the changes in the applied bias electric field. When the refractive index of the outer prismatic structure is reduced sufficiently to a low value, total internal reflection of the incident RF energy takes place and the switch is switched ON. By selecting an appropriate percentage of lead titanate in the strontium-lead titanate, the Curie temperature of the ferroelectric material can be brought slightly lower than the high Tc of a superconducting material.

With these and other objectives in view, as will hereinafter more fully appear, and which will be more particularly pointed out in the appended claims, reference is now made to the following description taken in connection with accompanying drawings.

DETAILED DESCRIPTION OF A TYPICAL EMBODIMENT

Figure 1:
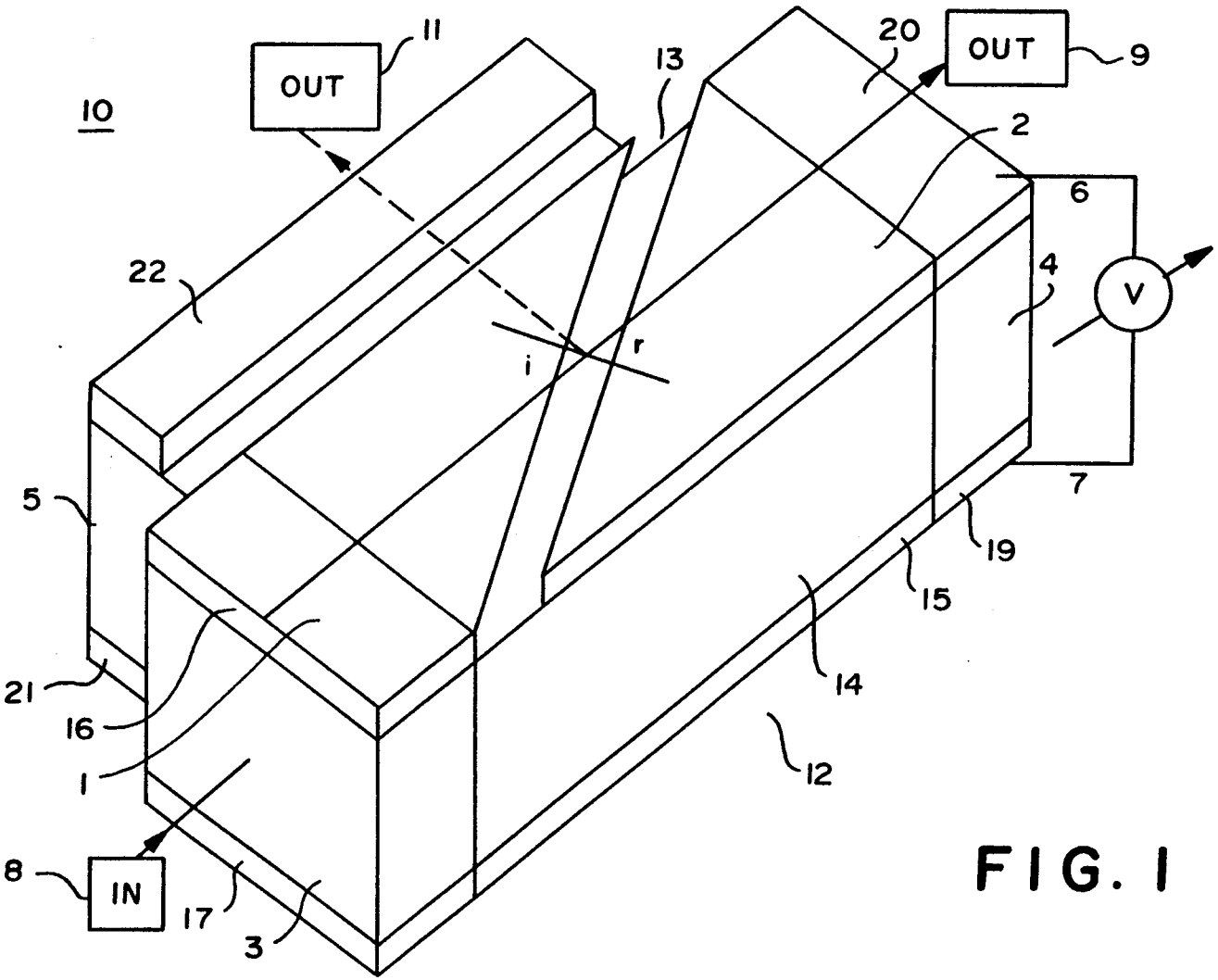
FIG. 1 is a pictorial, schematic diagram of a typical embodiment.

Referring now to the drawings, there is illustrated in FIG. 1 a typical microwave or millimeter wave circuit configuration that incorporates the principles of the present invention. Circuit 10 includes an RF input 8, an RF transmission line 12, a switch OFF output 9 and a switch ON output 11.

The circuit 10 might be part of a cellular, terrestrial, microwave, satellite, radio determination, radio navigation or other telecommunication system. The RF input may represent a signal generator which launches a telecommunication signal onto a transmission line 12 for transmission to a switch OFF output 9. When the switch 13 contained in the transmission line is switched ON, the signal is transmitted to the RF output 11.

In addition to the switch 13, the transmission line 12 contains a quarter-wave matching section 3 connected between the input of the switch 13 and the RF input 8 to match the impedance of the active section 1 to the impedance of the RF input 8. The top and bottom surfaces 16 and 17 of the quarter-wave matching section 3 are coated with conductive materials.

The active ferroelectric medium 14 is formed into two prismatic structures 1 and 2 by placing conductive coatings on the top with an appropriate uncoated area between the top coated surfaces. The bottom surface 15 of the active medium is coated with a conductive material.

The output of the switch 13, in the switch OFF condition, is connected to a quarter-wave impedance matching section 4. The output of the quarter-wave matching section is connected to the RF output 9. Both the upper and lower surfaces 20 and 19 of the quarter-wave section 4 are coated with a conductive material.

An adjustable d.c. or a.c. voltage source V is connected across the conductive surfaces 20 and 19 through wires 6 and 7.

The RF energy, fed at the input 8, is incident at the interface between the two prismatic structures at an angle i on the input prismatic structure and refracted at an angle r on the output prismatic structure. Without any bias voltage applied between 20 and 19 i.e. between 2 and 15, the angle of incidence is equal to the angle of refraction, the switch is in the OFF condition and the RF energy is transmitted to the RF output 9. The transmission is governed by Snell's law. With a bias voltage applied between 20 and 19, the permittivity and the refractive index of the output prismatic structure 2 decreases, and the RF energy is transmitted at an angle away from the normal at the interface between the two prismatic structures. When the bias voltage is sufficiently high, internal reflection of input RF energy takes place. The switch is ON and the RF energy travels along the dotted path to the RF output 11. The condition of total internal reflection is given by the ratio of refractive index of the prismatic structure 2 to the refractive index of the prismatic structure 1 is equal to the sin of the incidence angle i. When the switch is ON, a signal fed at 8 travels to the interface between the two prismatic structures, undergoes total internal reflection and is transmitted to 11.

A quarter-wave matching transformer 5 is connected between the input prismatic surface 1 and the RF output 11. The top surface 22 of the quarter-wave matching transformer 5 is coated with a conductive material with an appropriate uncoated region between 1 and 22. The bottom surface 21 of the quarter-wave matching transformer 5 is coated with a conductive material.

In order to prevent undesired RF propagation modes and effects, the height and the width of the transmission line 12 need to be controlled. The conductive coatings could be silver, gold, copper or high Tc superconductive material.

The active ferroelectric medium 14, the quarter-wave matching transformers 3, 4 and 5 could be in thin film configuration.

Figure 2:
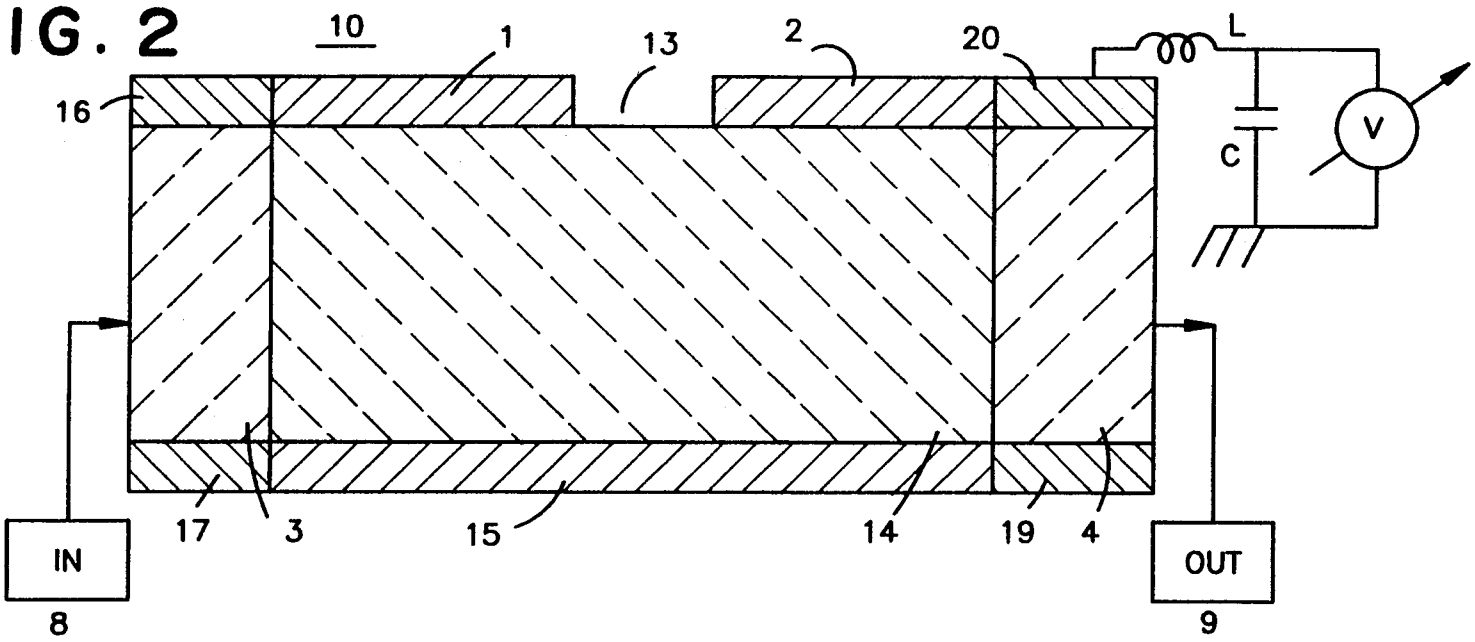
FIG. 2 is a schematic longitudinal section of a typical embodiment.

FIG. 2 is a longitudinal cross-section at the middle of the same circuit 10. The RF input is 8. The quarter-wave input matching transformer 3 is connected between the RF input 8 and the switch 13. Conducting coatings 16 and 17 are added on top and bottom surfaces of the input quarter-wave matching transformer. The input prismatic structure is formed by the conductive coating 1 on top of the ferroelectric medium 14. The output prismatic structure is formed by the conductive coating 2 on top of the ferroelectric medium. Between the two prismatic structures 1 and 2, there is an appropriate area of uncoated ferroelectric medium. The bottom surface of the ferroelectric medium is coated with a conductive material 15. A quarter-wave matching transformer 4 is connected between the output prismatic structure 2 and the RF output 9. Top and bottom surfaces 20 and 19 of the quarter-wave transformer 4 are coated with conductive materials. A variable voltage source V is connected between 20 and 19 i.e. between 2 and 15. A low-pass filter containing a series inductor L and shunt capacitor C is placed between 20 and the voltage source V. The inductor L places a high impedance to the RF energy and the capacitor C provides a low impedance path to any RF energy remaining at the end of the inductor L. The bottom surface of the transmission line and the switch are placed on a conducting housing connected to the ground. When the applied bias voltage is zero, the switch is in the OFF condition and the input fed at 8 is transmitted to the RF output 9.

Figure 3:
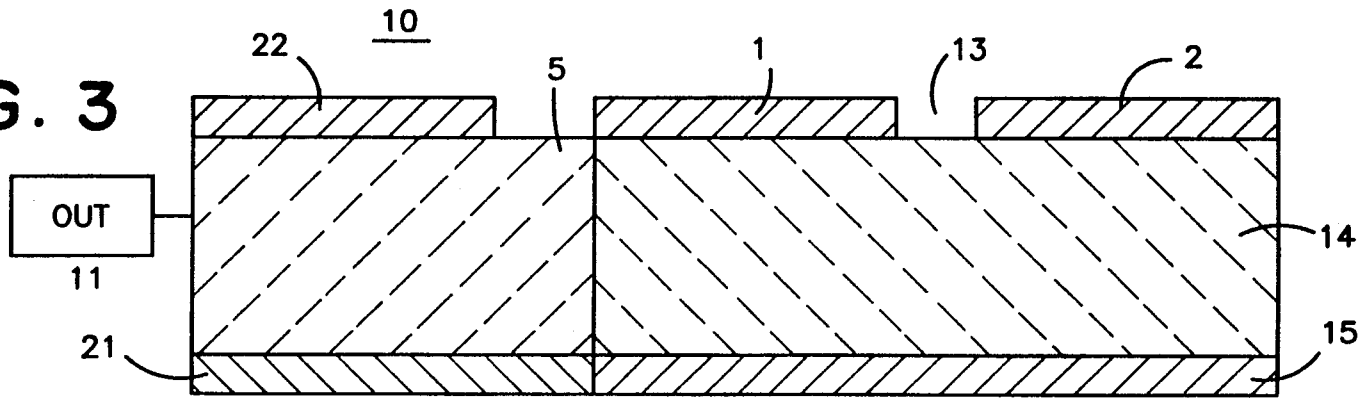
FIG. 3 is a schematic, transverse section of a typical embodiment.

FIG. 3 is a transverse cross-section at the middle of the same circuit 10. The switch ferroelectric medium is 14. The output prismatic structure is formed by a conductive coating 2 on top of the ferroelectric medium. The input prismatic structure is formed by a conductive coating 1 on top of the ferroelectric 14. An appropriate uncoated area on top of the ferroelectric medium is left between 1 and 2. The output quarter-wave transformer 5 is placed between the input prismatic structure 1 and the RF output 11. The top and bottom surfaces 22 and 21 of the output quarter-wave transformer 5 are coated with conductive materials with an appropriate uncoated area between 1 and 22. When the switch is ON, the RF energy is transmitted to the output 11.

A microstrip line configuration is shown in FIG. 1, FIG. 2 and FIG. 3 as a discrete device. However, the same drawings will depict a ferroelectric switch in a monolithic microwave integrated circuit configuration as a part of a more comprehensive circuit. The conductive coatings are microstrip line conductors.

The ferroelectric RF switch can also be configured in a waveguide structure.

It should be understood that the foregoing disclosure relates to only typical embodiments of the invention and that numerous modification or alternatives may be made therein without departing from the spirit and the scope of the invention as set forth in the appended claims.

What is claimed is:

1. A ferroelectric total internal reflection RF switch having an input and output and comprising of:

a body of ferroelectric material having a top and bottom surface and a permittivity and refractive index that are functions of an electric field in which it is immersed;

the said body of ferroelectric material being formed into input and output prismatic structures by placing conductive coatings, separated by an appropriate uncoated area, on the top surface;

a first RF transmission means for coupling RF energy into said body;

a second RF transmission means for coupling RF energy from said body when the applied bias voltage is substantially zero and the switch is OFF;

voltage means for applying an electric field to the output prismatic structure of the said body to reduce the permittivity and the refractive index of the output prismatic structure to obtain total internal reflection of input RF energy at the interface between the input and the output prismatic structures; and a third RF transmission means for coupling energy from the input prismatic structure of the said body when the applied bias voltage is sufficiently high and the switch is ON.

2. The switch of claim 1 wherein the conductive coatings are made of a high Tc superconductor material and the switch is operated at the high Tc superconducting temperature to minimize conducting losses; and means for keeping the said switch at the high Tc superconducting temperature.

3. The switch of claim 1 wherein the ferroelectric material is a ferroelectric liquid crystal (FLC).

4. The switch of claim 3 wherein the conductive coatings are made of a high Tc superconductor material and the switch is operated at the high Tc superconducting temperature to minimize conducting losses; and means for keeping the said switch at the high Tc superconducting temperature.

5. A ferroelectric total internal reflection RF switch having an input and output and comprising of:

a body of ferroelectric material having a top and bottom surface and a permittivity and refractive index that are functions of an electric field in which it is immersed;

the said body of ferroelectric material being formed into input and output prismatic structures by placing two microstrip line conductors, separated by an appropriate uncoated area, on the top surface;

a first microstrip line dielectric quarter-wave matching transformer for matching the input to the ferroelectric medium;

a second microstrip line dielectric quarter-wave matching transformer for matching the ferroelectric medium to the output when the applied bias voltage is substantially zero and the switch is OFF;

voltage means for applying an electric field to the output prismatic structure to reduce the permittivity and the refractive index of the output prismatic structure to obtain total internal reflection of the incident RF energy at the interface between the input and the output prismatic structure; and a third microstrip line quarter-wave matching transformer for coupling energy from the input prismatic structure of the said ferroelectric body when the applied bias voltage is sufficiently high and the switch is ON, the said third matching microstrip transformer having an appropriate uncoated area adjacent to the input prismatic structure.

6. The switch of claim 5 wherein the conductors are made of a high Tc superconductor material and the switch is operated at the high Tc superconducting temperature to minimize conducting losses; and means for keeping the said switch at the high Tc superconducting temperature.

7. The switch of claim 5 wherein the ferroelectric material is a ferroelectric liquid crystal (FLC).

8. The switch of claim 7 wherein the conductors are made of a high Tc superconductor material and the switch is operated at the high Tc superconducting temperature to minimize conducting losses; and means for keeping the said switch at the high Tc superconducting temperature.

9. A ferroelectric total internal reflection RF switch having an input and output and comprising of:

a film of ferroelectric material having a top and bottom surface and a permittivity and refractive index that are functions of an electric field in which it is immersed;

the said film of ferroelectric material being formed into input and output prismatic structures by placing two microstrip line conductors, separated by an appropriate uncoated area, on the top surface;

a first microstrip line dielectric film quarter-wave matching transformer for matching the input to the ferroelectric film;

a second microstrip line dielectric film quarter-wave matching transformer for matching the ferroelectric film to the output when the applied bias voltage is substantially zero and the switch is OFF;

voltage means for applying an electric field to the output prismatic structure of the said film to reduce the permittivity and the refractive index of the output prismatic structure to obtain total internal reflection of the input RF energy at the interface between the input and the output prismatic structures; and a third microstrip line dielectric film quarter-wave matching transformer for coupling energy from the input prismatic structure of the said ferroelectric film when the applied bias voltage is sufficiently high and the switch is ON, the said third matching transformer having an appropriate uncoated area adjacent to the input prismatic structure.

10. The switch of claim 9 wherein the conductors are made of a high Tc superconductor material and the switch is operated at the high Tc superconducting temperature to minimize conducting losses; and means for keeping the said switch at the high Tc superconducting temperature.

* * * * *